US006923661B1

(12) United States Patent
Bogiel et al.

(10) Patent No.: US 6,923,661 B1
(45) Date of Patent: Aug. 2, 2005

(54) POWER CONNECTOR FOR MOUNTING ON A CIRCUIT BOARD

(75) Inventors: Steven B. Bogiel, Lisle, IL (US); Arvind Patel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/870,343

(22) Filed: Jun. 17, 2004

(51) Int. Cl.[7] ..... H01R 9/09
(52) U.S. Cl. ..... 439/78; 439/79
(58) Field of Search ..... 439/78, 79

(56) References Cited

U.S. PATENT DOCUMENTS

| | | | | |
|---|---|---|---|---|
| 4,721,471 | A * | 1/1988 | Mueller | 439/78 |
| 5,158,471 | A | 10/1992 | Fedder et al. | 439/80 |
| 5,237,743 | A * | 8/1993 | Busacco et al. | 29/885 |
| 5,421,751 | A | 6/1995 | Bennett et al. | 439/843 |
| 5,431,576 | A | 7/1995 | Matthews | 439/247 |
| D372,220 | S | 7/1996 | Matthews | D13/133 |
| 5,630,720 | A | 5/1997 | Kocher | 439/78 |
| 5,860,814 | A * | 1/1999 | Akama et al. | 439/74 |
| D405,417 | S | 2/1999 | Matthews | D13/147 |
| 6,089,929 | A | 7/2000 | Stoey | 439/845 |
| 6,132,265 | A * | 10/2000 | Shih et al. | 439/885 |
| 6,210,240 | B1 | 4/2001 | Comerci et al. | 439/853 |
| 6,319,021 | B1 * | 11/2001 | Billman | 439/78 |
| 6,383,039 | B1 | 5/2002 | Yoneyama et al. | 439/856 |
| 6,402,525 | B2 | 6/2002 | Gugliotti et al. | 439/65 |
| 6,402,566 | B1 | 6/2002 | Middlehurst et al. | 439/699.1 |
| 6,431,886 | B1 | 8/2002 | Ramey et al. | 439/101 |
| 6,471,523 | B1 | 10/2002 | Shuey | 439/63 |
| 6,488,549 | B1 | 12/2002 | Weller et al. | 439/856 |
| 6,604,967 | B2 | 8/2003 | Middlehurst et al. | 439/862 |
| 6,705,902 | B1 | 3/2004 | Yi et al. | 439/678 |
| 2001/0000498 | A1 * | 4/2001 | Watanabe et al. | 439/66 |

* cited by examiner

*Primary Examiner*—Ross Gushi
*Assistant Examiner*—Phuongchi Nguyen
(74) *Attorney, Agent, or Firm*—Stephen Z. Weiss

(57) ABSTRACT

A low profile blade receiving electrical connector is provided for mounting on a printed circuit board. The connector includes a dielectric housing having a blade insertion cavity which extends generally parallel to the printed circuit board. A pair of generally U-shaped terminals are mounted on the housing, with one terminal nested within the other terminal. Each terminal includes a pair of side walls joined by a connecting beam. The side walls are generally perpendicular to and electrically connected to the circuit board. The connecting beams are generally parallel to the circuit board. The connecting beams of the two terminals are spaced from each other for receiving a terminal blade therebetween. The connecting beams have contact portions exposed in the blade insertion cavity of the housing for engaging opposite sides of the terminal blade.

16 Claims, 5 Drawing Sheets

POWER CONNECTOR FOR MOUNTING ON A CIRCUIT BOARD

FIELD OF THE INVENTION

This invention generally relates to the art of electrical connectors and, particularly, to a circuit board mounted power connector for mating with a blade terminal.

BACKGROUND OF THE INVENTION

Generally, an electrical connector includes some form of insulative or dielectric housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors. The interengaging terminals of the connectors, themselves, may be male and female terminals.

One type of electrical connector is a power connector which mounts one or more power terminals. With the ever-increasing density of components used in electronic packaging, electrical power connectors often are needed to carry high current between a circuit board and a complementary mating connector or other connecting device, or between one circuit board and another circuit board. A typical circuit board mounted power connector is a female connector designed to receive a power terminal blade or a bus bar. The current is distributed to various circuit traces on the circuit board.

A typical board mounted power connector includes a blade insertion cavity which extends vertically or in a plane perpendicular to the circuit board. Problems continue to be encountered with such connectors, because perpendicularly inserted terminal blades take up too much space above the circuit board. It would be desirable to provide a simple and efficient board mounted power connector that receives a terminal blade or bus bar in a direction generally parallel to the circuit board. Other problems with power connectors involved the rigidity of the connector housing when mating with a sizable power terminal blade or bus bar. It would desirable for the connector housing to have a controlled floating movement relative to the circuit board to avoid damage to the connector because of repeated mating and unmating with the terminal blade. Still further, vertically oriented power connectors which perpendicularly receive a terminal blade cannot be arranged in a tandem fashion, whereby a single terminal blade can be inserted through a plurality of connectors which would enhance the versatility of current distribution on the circuit board.

The present invention is designed to solve the above myriad of problems with board mounted power connectors and to provide improved features in such connectors.

SUMMARY OF THE INVENTION

An object, therefore, of the invention is to provide a new and improved circuit board mounted power connector of the character described.

In the exemplary embodiment of the invention, a low profile blade receiving electrical connector is provided for mounting on a printed circuit board. The connector includes a dielectric housing having a blade insertion cavity which extends generally parallel to the printed circuit board. A pair of generally U-shaped terminals are mounted on the housing, with one terminal nested within the other terminal. Each terminal includes a pair of side walls joined by a connecting beam. The side walls are generally perpendicular to and electrically connected to the circuit board. The connecting beams are generally parallel to the circuit board. The connecting beams of the two terminals are spaced from each other for receiving a blade terminal therebetween. The connecting beams have contact portions exposed in the blade insertion cavity of the housing for engaging opposite sides of the blade terminal.

As disclosed herein, the side walls of the terminals include a plurality of tail portions for electrical connection to appropriate circuit traces on the circuit board. In the exemplary embodiment, the side walls are generally planar and elongated generally parallel to the circuit board. The tail portions are coplanar with the side walls to define long rows of tail portions. The contact portions of the connecting beams comprise flexible contact arms cantilevered into the blade insertion cavity of the housing. The flexible contact arms have slotted convex contact surfaces for engaging the blade terminal.

According to one aspect of the invention, the elongated legs of the terminals are mounted loosely within a plurality of mounting slots in the housing. This allows for controlled floating movement of the housing relative to the terminals and the circuit board when the terminals are fixed to the board.

According to another aspect of the invention, the blade insertion cavity in the housing is open ended. This allows a pair of the connectors to be mounted on the circuit board in a side-by-side relationship, with the open ended cavities of the housings of the connectors being aligned. Therefore, a long blade terminal or bus bar can be inserted through the cavities of both connectors in a tandem arrangement to enhance or increase the current distribution capabilities of such a system.

Other features of the invention include the housing being recessed along a bottom wall thereof between the side walls of the terminals. This provides a heat-dissipating air cavity beneath the connector. The heat-dissipating air cavity is open ended to allow for air flow therethrough.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
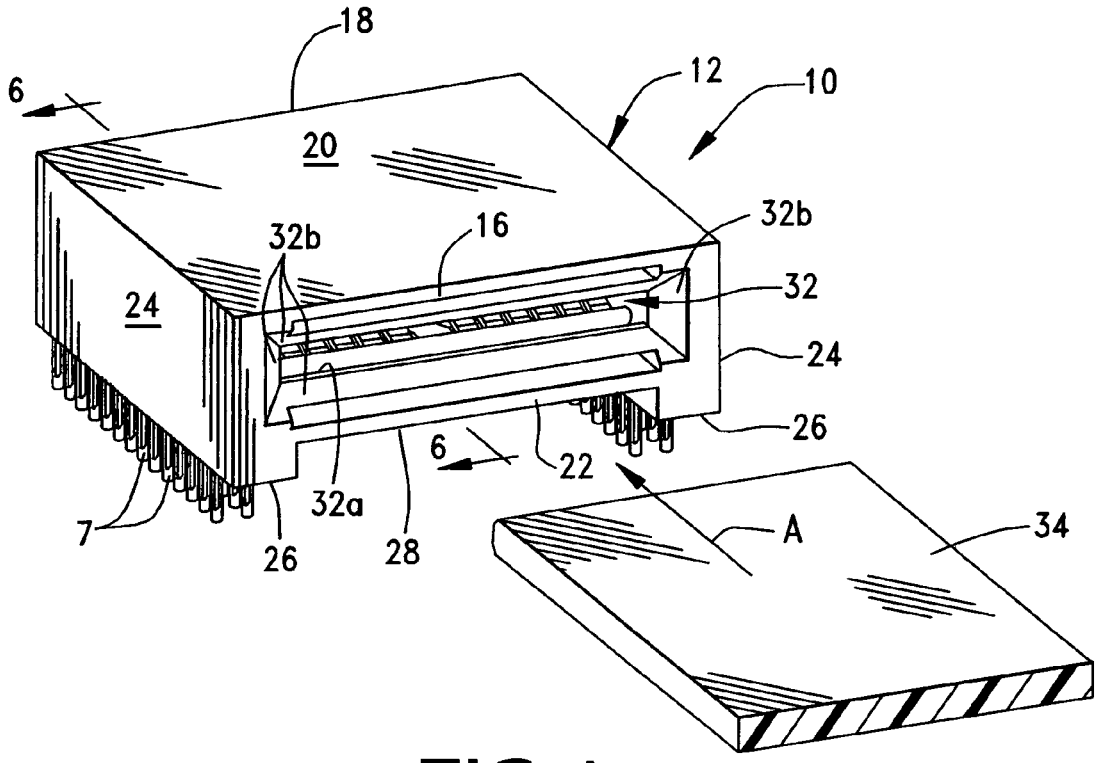
FIG. 1 is a perspective view of a power connector according to the invention, in conjunction with a blade terminal about to be inserted into the connector.
Figure 2:
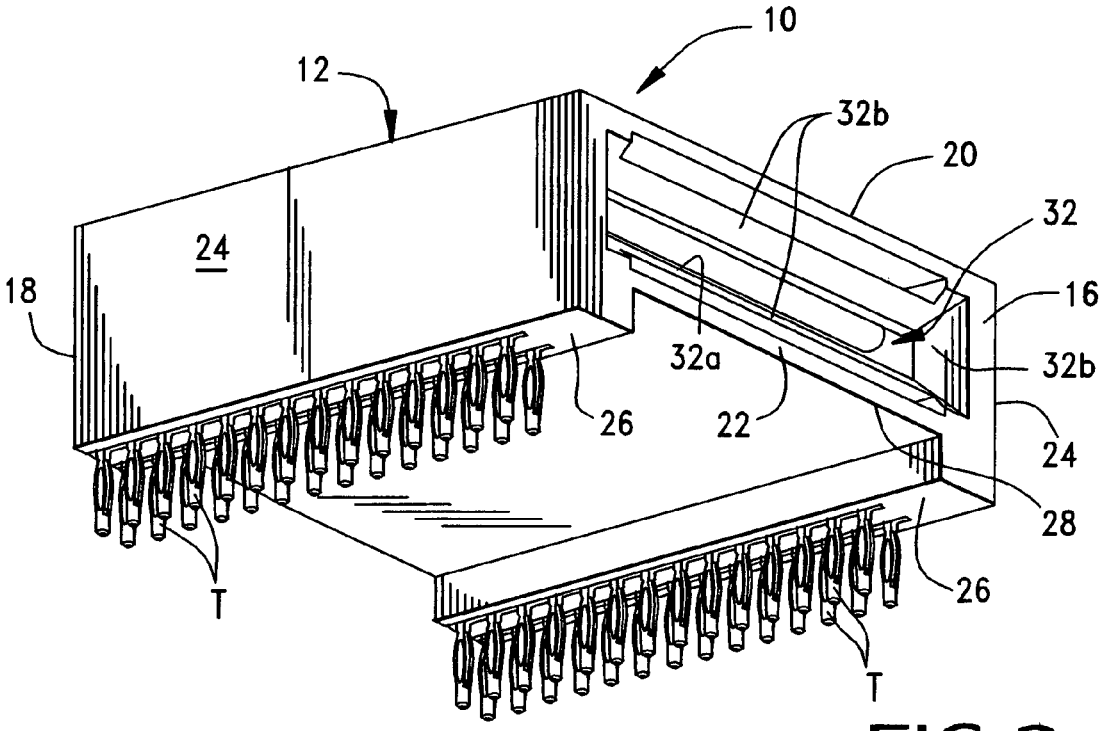
FIG. 2 is a bottom perspective view of the connector.

Referring to the drawings in greater detail, and first to FIGS. 1–3, the invention is embodied in a low profile, blade receiving power connector, generally designated 10, which includes a dielectric housing, generally designated 12, that mounts a pair of terminals, as will be described in greater detail hereinafter. The connector is designed for mounting on a printed circuit board 14 as seen in FIG. 3.

Figure 3:
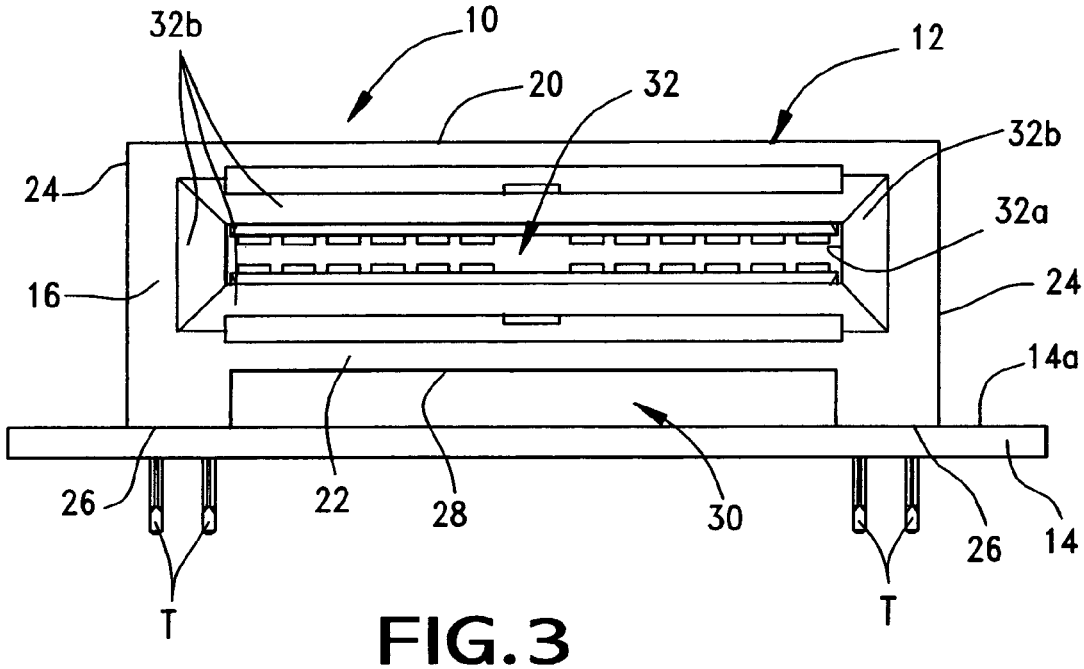
FIG. 3 is an end elevational view of the connector mounted on a printed circuit board.

Housing 12 of power connector 10 includes a front mating face 16, a rear face 18, a top wall 20, a bottom wall 22, a pair of side walls 24 and a pair of elongated board-mounting faces 26 which engage a top surface 14*a* of circuit board 14 as seen in FIG. 3. Bottom wall 22 is recessed, as at 28, to form a heat-dissipating air cavity, generally designated 30 (FIG. 3) beneath the connector. The heat-dissipating air cavity is open ended at front mating face 16 and rear face 18 of the housing to allow for air flow therethrough. Housing 12 has a blade insertion cavity, generally designated 32, which is open ended at front mating face 16 and rear face 18 of the housing. In other words, the blade insertion cavity extends entirely through the housing as can be seen in FIG. 3. The blade insertion cavity extends generally parallel to circuit board 14 for receiving a flat terminal blade or bus bar 34 inserted into the cavity in the direction of arrow "A" (FIG. 1). Cavity 32 has a blade-insertion opening 32*a* in front mating face 16 of the housing. Finally, housing 12 of power connector 10 is a one-piece structure which may be efficiently molded of dielectric plastic material or the like.

Figure 4:
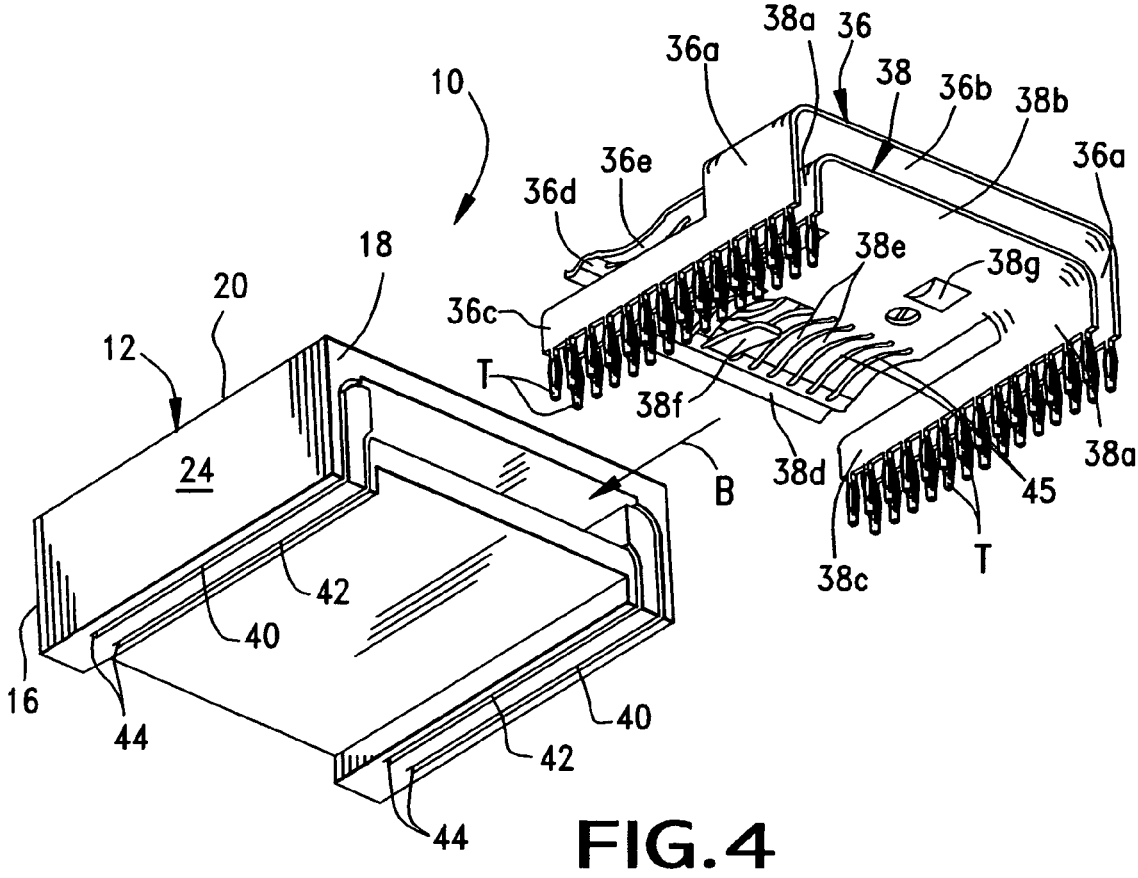
FIG. 4 is a bottom perspective view of the connector housing, with a pair of terminals about to be inserted into the housing.
Figure 5:
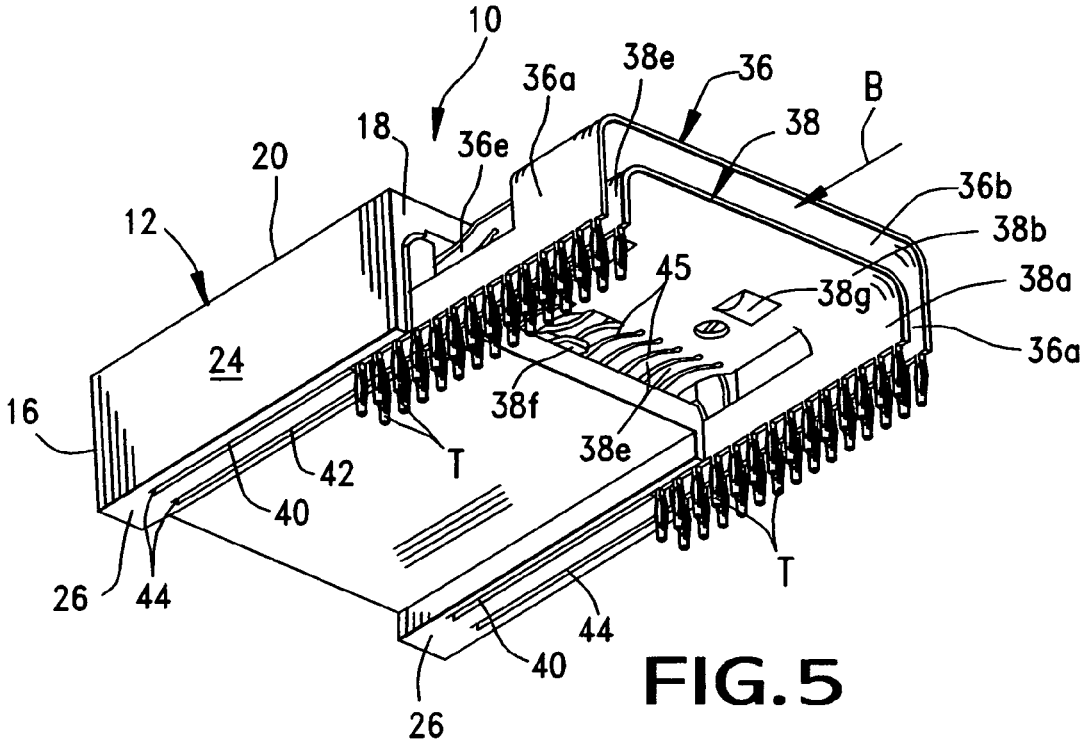
FIG. 5 is a view similar to that of FIG. 4, with the terminals being inserted into the housing.

FIGS. 4 and 5 show that power connector 10 includes a pair of generally U-shaped terminals, generally designated 36 and 38, which are mounted in the direction of arrows "B" into housing 12 through rear face 18 thereof. The housing has a pair of outside slots 40 which receive terminal 36, and a pair of inside slots 42 which receive terminal 38. The slots extend from rear face 18 of the housing and bottom out at a plurality of stop surfaces 44 which define the extreme inner ends of the slots. It can be seen that the U-shaped terminal 38 (the "inside" terminal) is smaller than the U-shaped terminal 36 (the "outside" terminal), whereby the inside terminal is nested within the outside terminal. The terminals may be efficiently stamped and formed of conductive sheet metal material.

Still referring to FIGS. 4 and 5, each U-shaped terminal 36/38 includes a pair of side walls 36*a*/38*a* joined by a connecting beam 36*b*/38*b*. The side walls are planar and are mounted to extend generally perpendicular to circuit board 14, and the connecting beams are planar and extend generally parallel to the circuit board. The side walls include elongated legs 36*c*/38*c* which extend forwardly of the connector. A plurality of terminating tail portions "T" depend along the bottom edges of the side walls to define four long rows of terminating tail portions. The connecting beams of the terminals have contact portions 36*d*/38*d* which are stamped and formed with slots 45 to define resilient convex contact members 36*e*/38*e* which engage opposite sides of terminal blade 34. Each terminal has an outwardly bent flexible latch tongue 36*f*/38*f* and an inwardly formed dimple 36*g*/38*g*, all for purposes described below.

Figure 6:
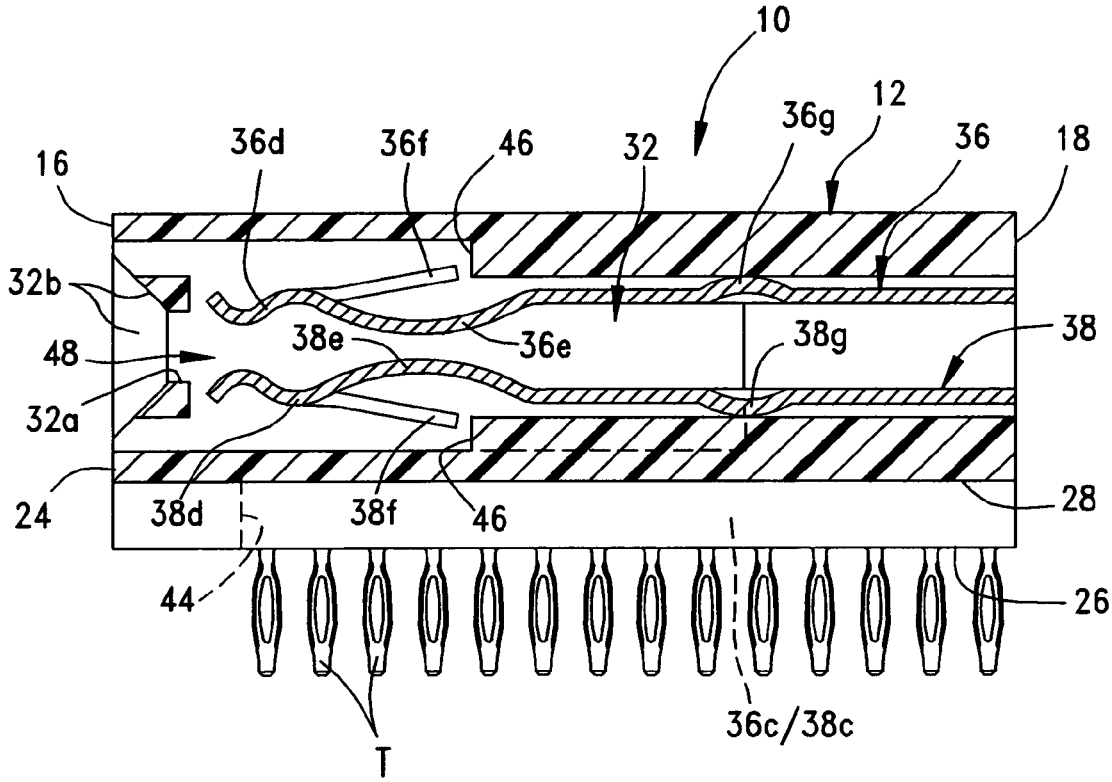
FIG. 6 is an enlarged vertical section taken generally along line 6—6 of FIG. 1.

FIG. 6 shows terminals 36 and 38 completely inserted into blade insertion cavity 32 of housing 12 of power connector 10. When fully inserted, the front ends of elongated legs 36*c*/38*c* of the side walls of the terminals abut against stop surfaces 44 at the extreme inner ends of slots 40 and 42 as described above in relation to FIGS. 4 and 5. This defines the fully inserted positions of the terminals. During insertion, resilient latch tongues 36*f*/38*f* snap behind a pair of latch shoulders 46 formed at the top and bottom of blade insertion cavity 32 as is seen clearly in FIG. 6. This prevents the terminals from being backed out of cavity 32. Dimples 36*g*/38*g* abut against the top and bottom walls, respectively, of cavity 32. When the terminals are fully inserted, tail portions "T" project downwardly below board mounting surface 26 of the housing for insertion into appropriate holes in the circuit board and for electrical connection to appropriate circuit traces on the board. It can be seen in FIG. 6 that contact portions 36*d*/38*d* of the terminals define a mouth 48 which is aligned with opening 32*a* of cavity 32 at front mating face 16 of the housing, for receiving terminal blade 34. When the terminal blade is inserted into the connector, resilient contact members 36*e*/38*e* engage the top and bottom surfaces, respectively, and the entire contact portions 36*d*/38*d* of the terminals can flex about dimples 36*g*/38*g* which engage the inside surfaces of cavity 32.

Figure 7:
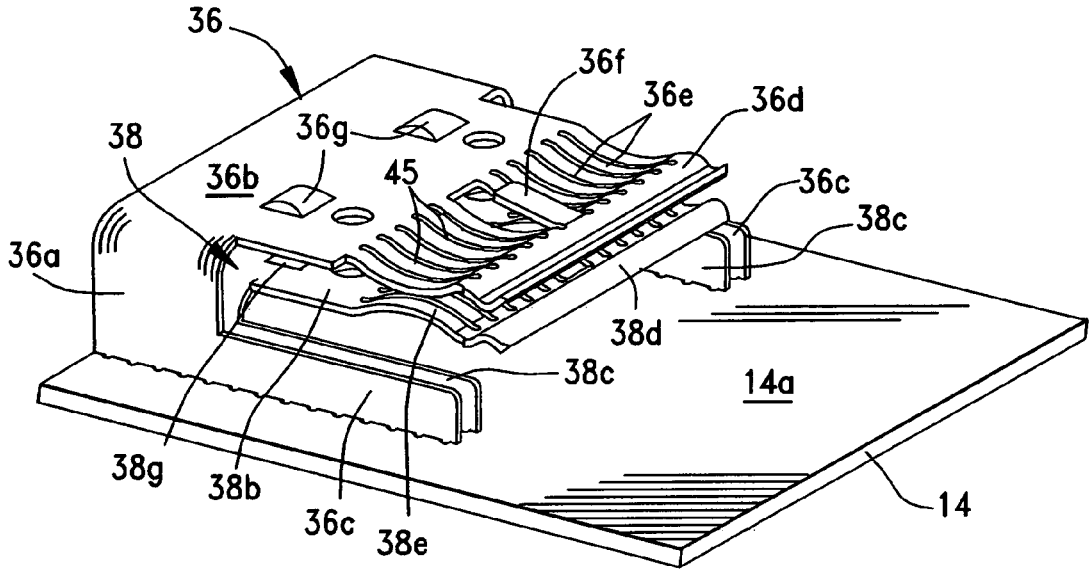
FIG. 7 is a top perspective view looking at the pair of terminals mounted on the circuit board, without the connector housing.
Figure 8:
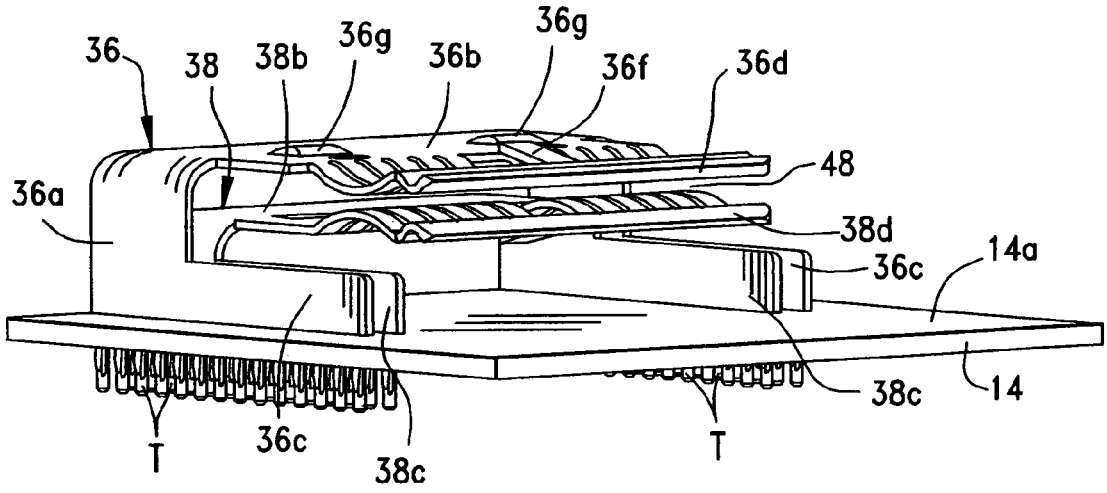
FIG. 8 is a perspective view somewhat similar to that of FIG. 7, but clearly showing the blade-receiving mouth between the terminals.

FIGS. 7 and 8 simply show the U-shaped terminals 36 and 38 mounted on top surface 14*a* of circuit board 14. It can be seen clearly how side walls 36*a*/38*a* of the terminals are generally perpendicular to the board, while connecting beams 36*b*/38*b* are generally parallel to the board. FIG. 8 shows how mouth 48 between contact portions 36*d* and 38*d* of the terminals extends generally parallel to the circuit board for receiving the planar terminal blade 34 in a direction generally parallel to the board.

FIGS. 7 and 8 also show the versatility in assembling power connector 10 of the invention. Specifically, terminals 36 and 38 can be assembled first into housing 12 as described above in relation to FIGS. 4–6 to form the completely assembled connector. The connector then can be assembled to circuit board 14 by inserting tail portions "T" of the terminals into the holes in the circuit board. Alternatively, FIGS. 7 and 8 show that the assembly can proceed by first inserting the terminals into the circuit board and then bringing housing 12 into position to slide the housing onto the terminals to the position shown in FIG. 6 wherein the housing is locked in position between the interengagement of the terminals with stop surfaces 44 within the housing and the interengagement of latch tongues 36*f*/38*f* with latch shoulders 46 within the housing.

A feature of the invention is that mounting slots 40 and 42 (FIGS. 4 and 5) are wider than the thickness of the elongated legs 36*c*/38*c* of the side walls with no portion of the housing slots 40/42 near the front mating face 16 holding the elongated legs in a direction perpendicular to the printed circuit board. At the same time the side walls 36*a*/38*a* where joined by connecting beams 36*b*/38*b* are held in the slots 40/42. This will allow controlled movement of the housing relative to the terminals so that the front mating face 16 of the housing can move toward and away from the printed circuit board while the housing rotates about the sidewalls and the connecting beams. Since the terminals are fixed to the circuit board, the housing has controlled floating movement relative to the circuit board. As seen in FIGS. 1–3 and 6, opening 32*a* of blade insertion cavity 32 is flared outwardly, as at 32*b*. Therefore, when terminal blade 34 is inserted into cavity 32, through opening 32*a*, in the direction of arrow "A" as shown in FIG. 1, flared surfaces 32*b* guide the blade into the cavity, and the controlled floating movement of housing 12 also facilitates insertion of the blade terminal or bus bar.

Figure 9:
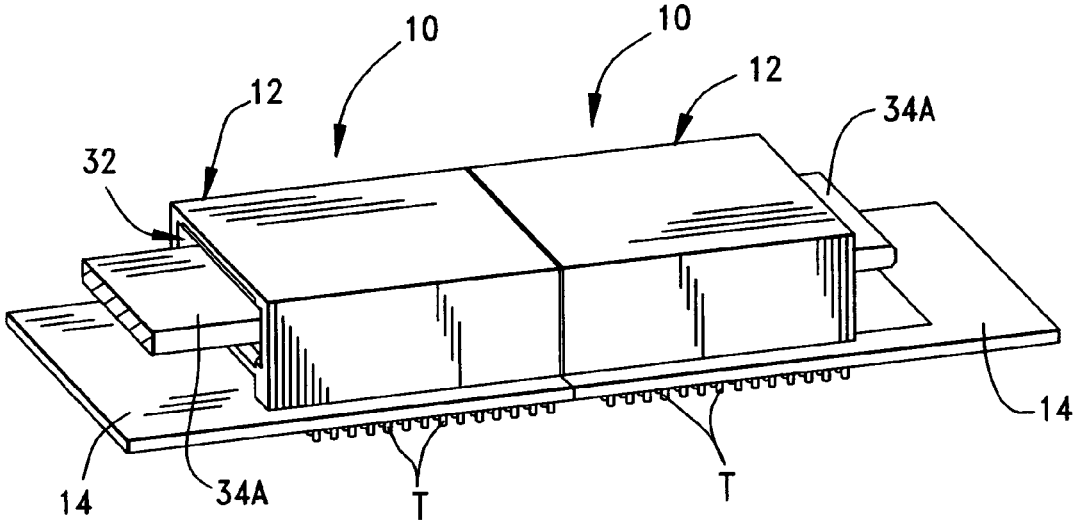
FIG. 9 is a perspective view of a pair of power connectors according to the invention, mounted in tandem on a pair of circuit boards.

FIG. 9 also shows a feature of the invention whereby a plurality of power connectors 10 can be mounted in tandem or in a side-by-side arrangement for receiving a long terminal blade or bus bar 34A that extends entirely through both tandem connectors. The connectors can be mounted on a pair of abutting circuit boards 14, as shown, or the connectors can be mounted in tandem on a single circuit board. By multiplying the connectors, a very large number of tail portions "T" can distribute current from the single blade terminal to a large number of circuit traces on the circuit board(s). This tandem arrangement is afforded by making the blade insertion cavities 32 of the connectors open ended, and constructing the terminals so that the single terminal blade can extend entirely through the connectors between the contact portions of the terminals as shown in FIG. 6.

Figure 10:
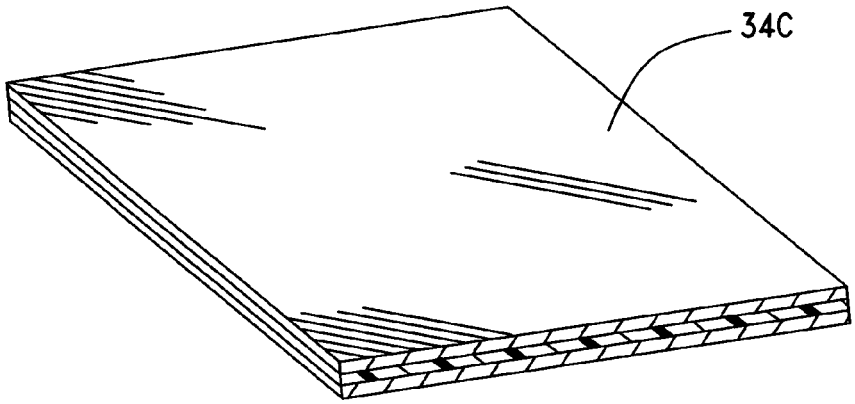
FIG. 10 is a perspective view of a blade terminal with two isolated conductive planes.

FIG. 10 shows a bus bar 34C which can be used in the power connector 10 to provide a unique feature. Bus bar 34C comprises two metal plates which are electrically isolated from each other by a layer of non-conductive material. With this arrangement, one metal plate of the bus bar engages a respective one of the terminals 35, 38 of the connector. Therefore the bus bar and connector can carry ether two different voltages or carry a supply current on one metal plate and carry a return current on the w other metal plate.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A low profile blade receiving electrical connector for mounting on a printed circuit board, comprising:

a dielectric housing having a blade insertion cavity which extends generally parallel to the printed circuit board; and a pair of generally U-shaped terminals mounted in the housing with one terminal nested within the other terminal, each terminal including a pair of side walls joined by a connecting beam, the side walls being generally perpendicular to and electrically connected to the circuit board, the connecting beams being generally parallel to the circuit board, the connecting beams of the two terminals being spaced from each other for receiving a terminal blade therebetween, and the connecting beams having contact portions exposed in the blade insertion cavity of the housing for engaging opposite sides of the terminal blade.

2. The low profile blade receiving electrical connector of claim 1 wherein said terminals have elongated legs mounted loosely within a plurality of mounting slots in the housing to allow for controlled floating movement of the housing relative to the terminals and the circuit board when the terminals are fixed to the board.

3. The low profile blade receiving electrical connector of claim 1 wherein said blade insertion cavity in the housing is open ended to allow a pair of said connectors to be mounted on the circuit board in a side-by-side relationship with the open ended cavities of the housings of the connectors being aligned, whereby a long terminal blade can be inserted through the cavities of both connectors in a tandem arrangement.

4. The low profile blade receiving electrical connector of claim 1 wherein the side walls of said terminals include a plurality of tail portions for electrical connection to appropriate circuit traces on the circuit board.

5. The low profile blade receiving electrical connector of claim 4 wherein said side walls are generally planar and elongated generally parallel to the circuit board, and said tail portions are coplanar with the side walls to define long rows of tail portions.

6. The low profile blade receiving electrical connector of claim 1 wherein the contact portions of said connecting beams comprise flexible contact arms cantilevered into the blade insertion cavity of the housing.

7. The low profile blade receiving electrical connector of claim 6 wherein the flexible contact arms are slotted to define convex contact members for engaging the terminal blade.

8. The low profile blade receiving electrical connector of claim 1 wherein said housing is recessed along a bottom wall thereof between the side walls of the terminals to provide a heat-dissipating air cavity beneath the connector.

9. The low profile blade receiving electrical connector of claim 8 wherein said heat-dissipating air cavity is open ended to allow for air flow therethrough.

10. An electrical power connector for mounting on a printed circuit board, comprising:

a dielectric housing having a blade insertion cavity which extends generally parallel to the printed circuit board, said blade insertion cavity being open ended to allow a pair of said connectors to be mounted on the circuit board in a side-by-side relationship with the open ended cavities of the housings of the connectors being aligned, whereby a long terminal blade can be inserted through the cavities of both connectors in a tandem arrangement; and terminal means in said housing including at least one contact portion for engaging the terminal blade and a terminating portion electrically connected to the circuit board.

11. The electrical power connector of claim 10 wherein said blade insertion cavity has a wide dimension and a narrow dimension in cross-section, with the wide dimension extending generally parallel to the printed circuit board whereby the housing can be provided with a low profile relative to the printed circuit board.

12. An electrical power connector for mounting on a printed circuit board, comprising:

a dielectric housing having a blade insertion cavity which extends generally parallel to the printed circuit board, the housing having at least one mounting slot;

at least one U-shaped terminal having a pair of side walls joined by a connecting beam, the sidewalls defining a pair of mounting portions with elongated legs extending from the mounting portion positioned in the mounting slot of the housing, a contact portion exposed in the blade insertion cavity of the housing for engaging a terminal blade inserted into the cavity generally parallel to the printed circuit board, a terminating portion exposed exteriorly of the housing for electrical connection to the printed circuit board, and the pair of elongated legs of the terminal being loosely received in the mounting slot of the housing to allow for controlled floating movement of the housing relative to the terminal and the printed circuit board when the terminating portion of the terminal is fixed to the board.

13. The electrical power connector of claim 12 wherein said contact portion of the terminal is on the connecting beam thereof.

14. The electrical power connector of claim 13 wherein said contact portion comprises a flexible contact arm cantilevered into the blade insertion cavity.

15. The electrical power connector of claim 13 wherein said terminating portion of the terminal comprises at least one tail portion insertable into an appropriate hole in the printed circuit board.

16. The electrical power connector of claim 15 wherein said side walls of the terminal are generally planar and elongated generally parallel to the printed circuit board, and including a plurality of said tail portions coplanar with and depending from the side walls to define a pair of long rows of tail portions for electrical connection to the printed circuit board.

* * * * *